United States Patent [19]

Higgins

[11] Patent Number: 4,707,227

[45] Date of Patent: Nov. 17, 1987

[54] SIMULTANEOUS ELECTRO-DEPOSITION OF MANGANESE AND MANGANESE DIOXIDE

[76] Inventor: Irwin R. Higgins, 113 Clarion Rd., Oak Ridge, Tenn. 37830

[21] Appl. No.: 907,509

[22] Filed: Sep. 15, 1986

[51] Int. Cl.[4] ..... C25C 1/00

[52] U.S. Cl. ..... 204/96; 204/105 M; 204/103; 210/660; 210/661

[58] Field of Search ..... 204/96, 105 M, 103; 210/600, 661

[56] References Cited

U.S. PATENT DOCUMENTS

| | | | |
|---|---|---|---|
| 2,815,322 | 12/1957 | Higgens | 210/33 |
| 3,535,217 | 10/1970 | Amano et al. | 204/96 |
| 3,770,868 | 11/1973 | Swinkels et al. | 423/50 |
| 3,790,458 | 2/1974 | DeMuria et al. | 204/96 |
| 3,855,089 | 12/1974 | McCutchen | 204/105 M |

OTHER PUBLICATIONS

"Mn Electrodep. from $SO_4^=$, $Cl^-$, and Mixed Soln's . . . " by G. Parissis et al., Metallurgical Soc. of AIME.

"Acid Retardation", by M. J. Hatch et al., I & EC Process Design & Dev., vol. 2, #4, Oct.1963.

*Primary Examiner*—R. L. Andrews

*Attorney, Agent, or Firm*—Pitts and Brittian

[57] ABSTRACT

An electro-deposition process for simultaneously producing manganese metal and manganese dioxide. Manganese metal and manganese dioxide are simultaneously electro-deposited in an electrolytic cell without the use of membranes separating the anode and cathode compartments. This is accomplished using a manganese chloride electrolyte in a temperature range of about 70 to 90 degrees C., with the free hydrochloride acid being removed from the electrolyte to a level below about 0.1M. The acid removal can be accomplished, for example, with an acid retardation step involving the use of strong base ion exchange resins in the preferred form. This is carried out in a continuous countercurrent current ion exchanger such that the molarity of the electrolyte is achieved with the acid being removed. The process described is suitable for the economical electrodeposition of manganese metal and manganese dioxide from leach solutions obtained from relatively low assay ores having of the order of 10 percent manganese. The current density and current efficiency are such that an economical process is achieved that is competitive with the processes of the prior art utilizing high grade ores.

21 Claims, 3 Drawing Figures

SIMULTANEOUS ELECTRO-DEPOSITION OF MANGANESE AND MANGANESE DIOXIDE

TECHNICAL FIELD

This invention relates generally to electro-chemical processes, and more particularly to the simultaneous electro-deposition of manganese metal and manganese dioxide in an undivided electrolytic cell. The conditions of this process lead to high current densities and high current efficiencies.

BACKGROUND ART

There is a growing demand for manganese metal for use in the preparation in both ferrous and non-ferrous alloys. Furthermore, high purity manganese dioxide ($MnO_2$) is a key component of long-life batteries. Both manganese metal and manganese dioxide are strong contendors as the media of transfer of stationary electrical power to electric vehicles. The cost of preparation of these materials is paramount for consideration in this application.

The conventional methods for preparing both manganese metal and manganese dioxide, each of high purity, is electro-deposition from a sulfate solution. Manganese dioxide is formed at the anode of an electrolyte cell and hydrogen is produced as a waste product. A cathode reaction produces manganese metal with oxygen as the waste product. Because of the significantly different operating conditions required for the production of these two materials, the reaction is carried out in two separate electrolytic cells and thus the electro-deposition of manganese metal and manganese dioxide are relatively expensive. If both products can be made in the same cell, electricity costs are cut approximately in half.

Studies have been made for producing two manganese products [$Mn(OH)_2$ and $MnO_2$] in the same cell. This is described in the patent issued to N. V. Demuria, et al., U.S. Pat. No. 3,790,458, issued Feb. 5, 1974. According to this process, there is a saving in electricity; however, the current density is low and the cell structure is complex because membranes are required to physically separate two different electrolytes used for the production of these two manganese products. Demuria used sulfate electrolytes just as used in the production type of electrolytic cells described above.

Manganese dioxide is a by-product of certain other electrolytic processes. For example, it is a by-product of the electro-winning with zinc from purified zinc sulfate. The electro-deposition of manganese cannot be achieved in these systems with any high degree of current efficiency or current density because of the acid conditions in this sulfate media.

Another process for the production of manganese dioxide is disclosed in U.S. Pat. No. 3,770,868, issued to D. A. J. Swinkels, et al., on Nov. 6, 1973. This process involves the leaching of ores with hydrochloric acid in the presence of manganese chloride or magnesium chloride. This process does not utilize electro-deposition as in the other prior references cited above. The significant feature disclosed in this patent is that divalent manganese is oxidized by chlorine in low acid concentrations.

In other studies, the electro-deposition of manganese from sulfate, chloride, and mixed solutions has been conducted in electrolytic cells having a diaphram separating the anode and cathode regions. This work is reported by G. Parissis', et al., Paper No. A82-27 of *The Metallurgical Society of AIME.* It reports work performed in partial fulfillment in the requirements for a Ph.D degree. In general, it was found that higher current densities, current efficiencies, and overall power consumption per unit of production was achieved from chloride media.

As stated above, the cost of production of manganese metal and manganese dioxide is an essential factor, and for this reason high grade ores have been utilized for this purpose. However, essentially all of the high grade ores are exterior to the United States and therefore the ore (or products from the ore) must be imported. On the other hand, the United States has tremendous reserves of relatively low grade manganese ore which could be utilized if an efficient process was established. By low grade ore is meant ore that contains approximately ten (10) percent manganese. There is, for example, an extensive ore source that exists in a portion of the State of Maine which source extends into New Brunswick, Canada. This low grade ore is considered impractical for direct use in furnace steel products as compared to those from the higher grade feed stock from outside the United States. At the present time there has been no practical use of the low grade ore existing in the United States.

Accordingly, it is one object of the present invention to provide a process whereby ores containing on the order of ten (10) percent manganese can be utilized for the efficient production of manganese metal and manganese dioxide.

It is another object of the present invention to provide an electro-chemical process which utilizes the manganese from low grade ores in an electrolytic cell wherein high current densities and high current efficiencies are achieved to economically produce manganese and manganese dioxide.

It is a further object of the present invention to simultaneously electro-deposit, from a chloride media, manganese metal and manganese dioxide at the cathode and anode, respectfully, of an electrolytic cell having no partition between the anode and cathode compartments.

It is a further object of the present invention to develop an electro-deposition process for achieving high purity manganese metal and manganese dioxide from a chloride media by maintaining the hydrogen chloride within the electrolyte to a value less than about 0.1M.

These and other objects of the present invention will become more apparent upon a consideration of the accompanying drawings and the complete description of the invention as follow.

SUMMARY OF THE INVENTION

According to the present invention, the simultaneous electro-deposition of manganese metal and manganese dioxide is carried out in an electrolytic cell from a chloride electrolyte when the free hydrochloric acid concentration of the electrolyte is maintained below about 0.1M. High current density and high current efficiency are achieved such that an economical electro-deposition process is provided. Although high grade foreign ore will suffice as a starting material, the lower grade source, typically of the quality of Northern Maine ore, may be prepared as high purity $MnCl_2$ at equal or lower cost. The electro-deposition is carried out with the electrolyte being at about 70 to 90 degrees Centigrade as one efficiency factor in $MnO_2$ formation. The preferred method for maintaining a low HCl molarity is the continuous contacting of the electrolyte with a strong base-type ion exchange resin wherein the acid is removed and concentrated such that it is available for use in the ore processing step to produce a feed solution to the electrolytic cell. Manganous hydroxide or carbonate are attractive starting materials whenever available at lower cost than manganous chloride.

BEST MODE FOR CARRYING OUT THE INVENTION

Figure 1:
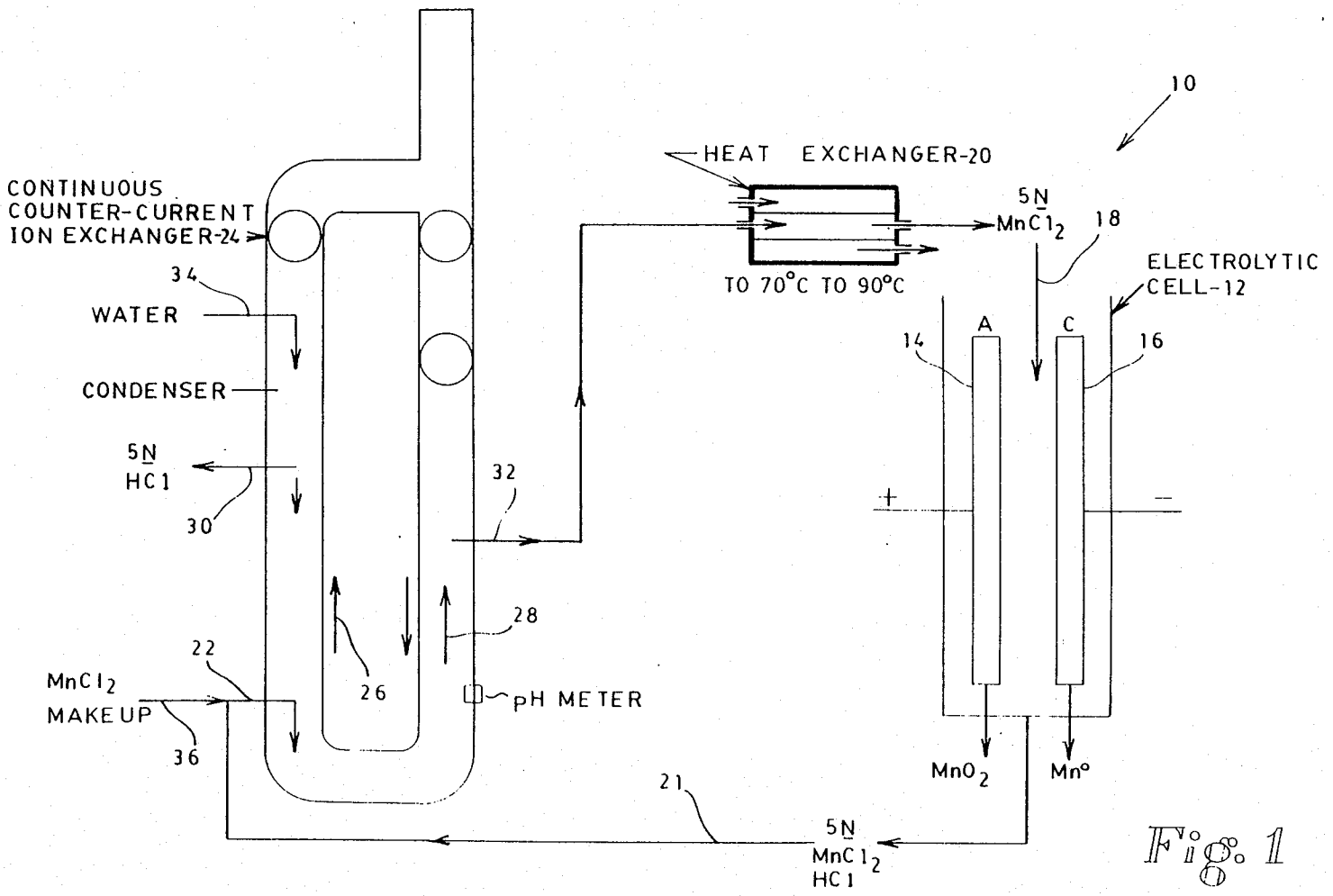
FIG. 1 is a flow diagram of a process for the simultaneously deposition of manganese metal and manganese dioxide in an undivided electrolytic cell with the preferred method of acid reduction illustrated.

Referring now to FIG. 1, shown at 10 therein is a preferred embodiment of the basic steps of electrodeposition and acid removal. An electrolytic cell 12 of essentially conventional design has an anode 14 and an cathode 16 mounted therein using conventional technology. A manganous chloride electrolyte of about 0.5N to about 5N $MnCl_2$ (about 4–5N preferred) enters the cell 12 at the top as indicated by the arrow 18. This electrolyte has previously passed through a heat exchanger 20 for the purpose of achieving a temperature in the range of about 70 degrees C. to 90 degrees C., the preferred range for carrying out the simultaneous electro-deposition of manganese dioxide and manganese metal. The electrolyte leaves the bottom of a cell 12 through the line 21, and at this point contains a substantial quantity of free HCl which would be detrimental to the current density and current efficiency of the cell if reused. This electrolyte exiting from the cell 12 enters through line 22 into a counter-current ion exchanger 24. The exchanger contains a strong-base type ion exchange resin. What is carried out in the ion exchanger is essentially a "acid retardation" method of the type described by M. J. Hatch, et al., in *I&EC Process Design and Development.* Volume 2, No. 4, October 1963. The technology of this reference is incorporated herein by reference. Movement of the ion exchange is in a direction indicated by the arrow 26, while the $MnCl_2$ solution moves in the direction indicated by the arrow 28. The hydrochloric acid is removed by the exchange resin and moves upwardly countercurrent to the $MnCl_2$ flow such that the acid is concentrated to approximately 5N HCl. This concentrated acid is removed from the column at point indicated by the arrow 30. The $MnCl_2$, with the HCl removed, leaves the exchanger at the point indicated at 32 and thereafter flows through the heat exchanger 20 for reuse in the cell 12.

The only "feed" materials for the process shown in FIG. 1 are water, which is added at point 34, and make up manganese chloride that is added at point 36. There are no waste products from this process since the concentrated HCl can be utilized for the production of the needed manganese chloride. A continuous countercurrent ion exchange contactor for use with this process is described in U.S. Pat. No. 2,815,322, issued to I. R. Higgins on Dec. 3, 1957. The contents of that patent are incorporated herein by reference.

The process of FIG. 1 was demonstrated in a plate type electrolytic cell having a five inch by six inch titanium cathode and a five inch by seven and one-half inch fritted titanium anode impregnated with manganese dioxide. Spacing between the electrodes was three-fourths inch. A 5N $MnCl_2$ electrolyte containing about 0.1M HCl was circulated through a heat exchanger to raise the temperature above 70 degrees C. The electrolyte also was passed through a bed of base-type ion exchange resin to remove all free HCl as fast as formed. A current density of about 0.3 Amperes per square inch was used. The cathode current efficiency was measured to be 91 percent, and the anode current efficiency was about 90 to 100 percent. No odor of chlorine was noted above the top of the open electrolytic cell.

In order to demonstrate the importance of the continuous removal of HCl, a corresponding operation was made without the removal of the HCl. After one hour of operation, the cathode current efficiency fell to 34 percent, and there was a substantial odor of chlorine above the cell. The electrolyte turned dark with $MnCl_3$ and/or $MnCl_4$. Also, there was no observed deposition of manganese dioxide. The final acid strength of the manganese chloride electrolyte was 0.17M in hydrogen ion. The main end products of this operation were hydrogen and chlorine gases instead of manganese metal and manganese dioxide.

Figure 2:
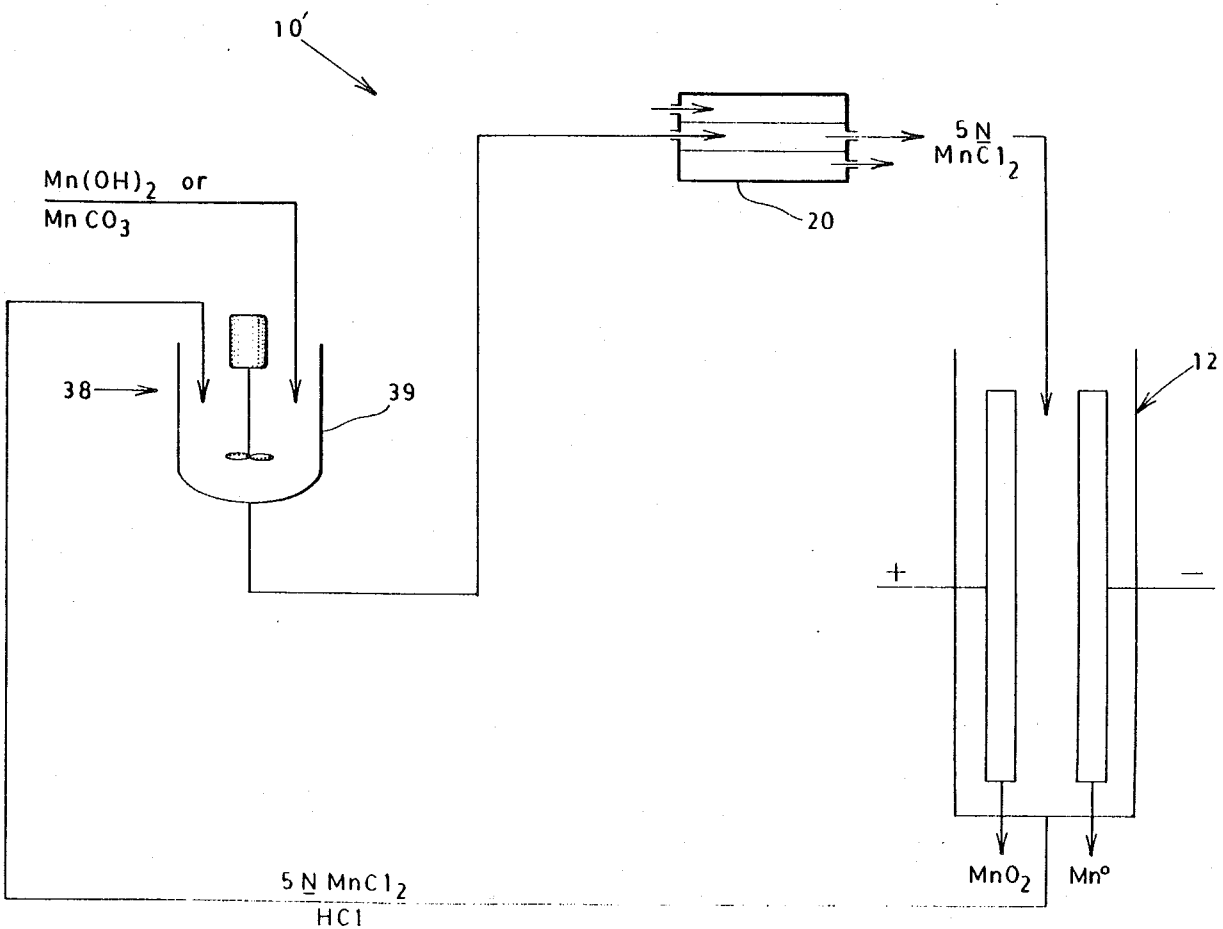
FIG. 2 is a flow diagram of a process similar to that of FIG. 1 except that an alternate method of acid reduction is illustrated.

Referring now to FIG. 2, shown therein is an alternative to the "Acid Retardation" as a means for lowering the HCl content of the electrolyte. This alternative is indicated at 38 in the figure. In this alternative, the $MnCl_2$ electrolyte having the HCl contained therein is contacted in a mixer 39 with manganese hydroxide or manganese carbonate. Both of these components react with the free HCl to produce additional manganese chloride for use in the electrolyte with the subsequent neutralization of the free HCl. This alternative is preferred only when $Mn(OH)_2$ or $MnCO_3$ are lower cost intermediates than $MnCl_2$. The $Mn(OH)_2$ or $MnCO_3$ will achieve the required reduction of the HCl to less than approximately 0.1M so that the $MnCl_2$ can be returned through the heat exchanger 20 to the electrolytic cell 12.

Figure 3:
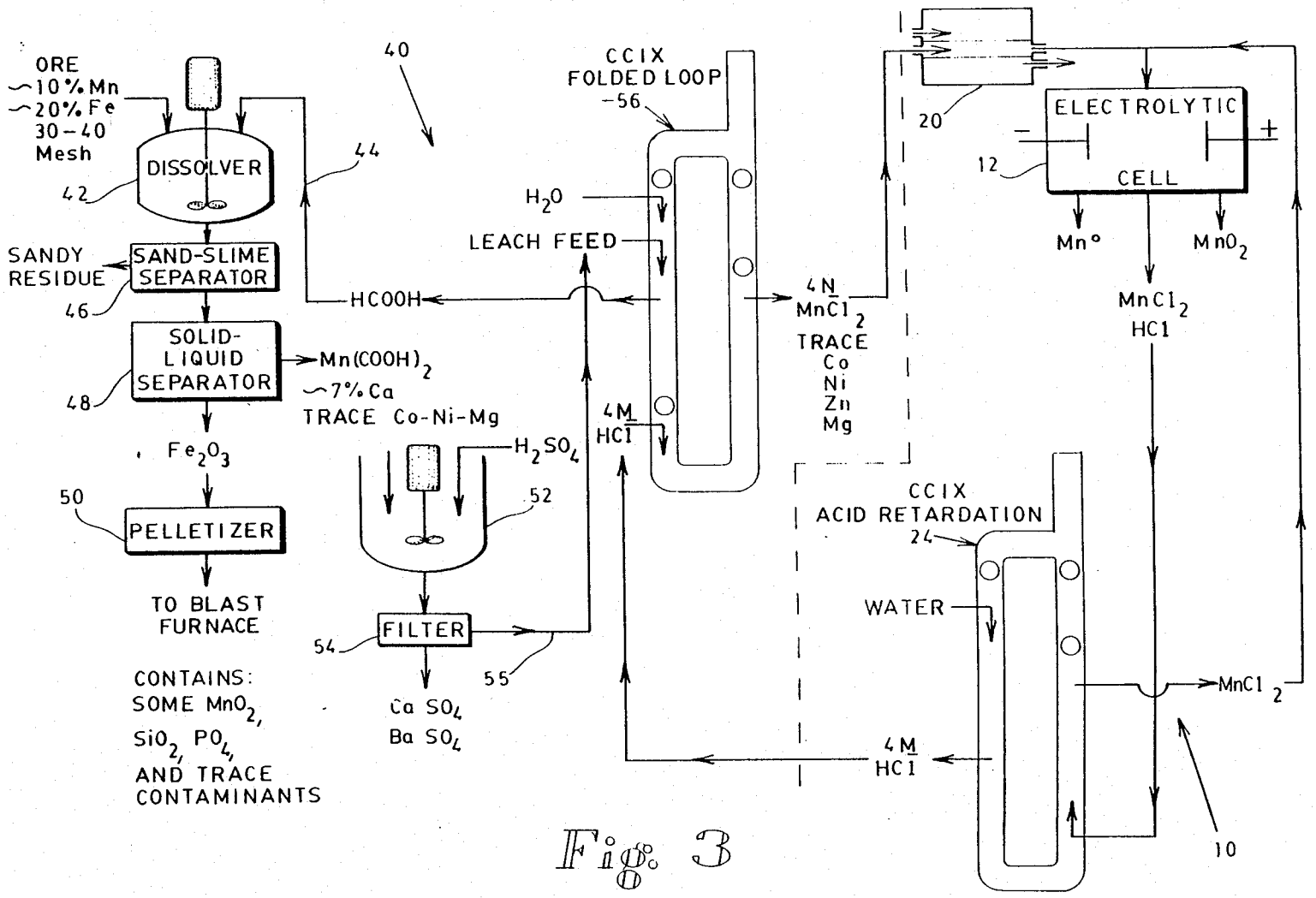
FIG. 3 is a flow diagram illustrating the use of the electrolytic production of manganese metal and manganese dioxide with acid removal (as in FIG. 1) together with an ore treatment process such that ore having as little as about ten (10) percent manganese can be efficiently converted into manganese metal and manganese dioxide whereby the cost will be competitive with processes now utilized for high grade ores which are only found outside of the United States.

Referring now to FIG. 3, shown therein is a flow diagram for a process beginning with the dissolution of ore to the ultimate simultaneous electro-deposition of manganese metal and manganese dioxide. The portion of the flow diagram to the right, and identified by the numeral 10, is the process described with regard to FIG. 1. The remainder of the figure designated as 40 is the portion involving the ore dissolution and the feed preparation steps necessary for the electrolytic cell. This process is designed to use relatively low grade ore having, for example, about ten percent (10%) manganese and about twenty percent (20%) iron. This particular ore although low grade and high in iron is very low in many trace metal contaminants. Ore of a thirty to forty mesh size is fed to a dissolver 42 where it is contacted with a formic acid solution (HCOOH) entering through line 44. The formic acid solution may be five percent to fifty percent, but these are not strict limits. The products from the dissolver are fed into a sand-slime separator 46, and the solids and liquids from that separator go into a further separator 48. The resultant solids, primarily iron oxide ($Fe_2O_3$), are fed to a pelletizer 50 with these pellets suitable for being used in conventional blast furnaces.

The liquid from the solid/liquid separator 48 passes to a mixer 52 where it is contacted with sulfuric acid producing, for example, solids such as calcium sulfate and barium sulfate. This is a convenient method of taking out the calcium, which is present as a contaminant at about 7% the manganese concentration. The solids and the liquid phase are separated by filter 54 with the resultant liquid phase containing the manganese being fed through line 55 to a continuous countercurrent ion exchanger 56. It is within this ion exchanger 56 that the manganese feed (formic) solution is converted to manganese chloride by contacting the same with approximately 4M HCl that is derived from the acid retardation step of the electro-deposition process. The formic acid is recycled to the ore dissolver. The manganese chloride then becomes a feed solution for the electrolytic cell. It can be seen through the use of continuous countercurrent ion exchangers there is essentially no loss of material, and essentially no new material added other than that necessary to make up for the manganese products that are deposited at the anode and cathode, respectfully, of the electrolytic cell.

From the foregoing, it will be understood by those versed in the art that an electro-deposition process has been developed for the simultaneous electro-depositing of manganese metal and manganese dioxide in a single electrolytic cell without the requirement for a membrane or other divider between the anode and cathode compartments of the cell. High current efficiencies and current densities are achieved and an efficient electro-deposition occurs when the free HCl in the electrolyte is maintained at a very low value, for example, below about 0.1M. The preferred method for achieving this low concentration of HCl in the electrolyte is a continuous ion exchange step involving acid retardation.

Although only a single set of cell conditions is set forth as an example of the present invention, the invention is not to be limited by these conditions. Rather the invention is to be limited only by the appended claims and their equivalents.

I claim:

1. A process for the simultaneous deposition of manganese metal and manganese dioxide from a manganese chloride electrolyte in an undivided electrolytic cell having a cathode and an anode, which comprises:

introducing said manganese chloride electrolyte into said electrolytic cell;

passing electrical current through said electrolytic cell to simultaneously deposit said manganese metal at said cathode and said manganese dioxide at said anode; and continuously removing free hydrochloric acid from said manganese chloride electrolyte to maintain said electrolyte at less than 0.1M free hydrochloric acid.

2. The process of claim 1 wherein said manganese chloride electrolyte is about 0.5M to 5M $MnCl_2$.

3. The process of claim 1 wherein said manganese chloride electrolyte is maintained in a temperature range of about 70 degrees to about 90 degrees C.

4. The process of claim 1 wherein said manganese chloride is continuously flowed through said electrolytic cell.

5. The process of claim 4 wherein said manganese chloride electrolyte is continuously contacted with a strong base ion exchange resin to maintain said free hydrochloric acid at less than 0.1M.

6. The process of claim 5 wherein said resin is contained in a continuous countercurrent ion exchanger, and hydrochloric acid removed by said resin is concentrated for reuse.

7. The process of claim 1 wherein said electro-deposition is carried out at a current density of about $0.3A/in^2$ with a current efficiency of about at least 90 percent.

8. The process of claim 4 wherein said manganese chloride electrolyte is contacted with manganese hydroxide to maintain said free hydrochloric acid at less than 0.1M.

9. The process of claim 4 wherein said manganese chloride electrolyte is contacted with manganese carbonate to maintain said hydrochloric acid at less than 0.1M.

10. The process of claim 6 wherein said electrolyte is produced by contacting said concentrated hydrochloric acid with a manganese-containing leach solution obtained from manganese ores having approximately ten percent manganese.

11. The process of claim 10 wherein said manganese-containing leach solution is a formic acid solution derived from contacting said manganese ore with formic acid.

12. An electrolytic process for the simultaneous deposition of manganese metal and manganese dioxide from a manganese chloride electrolyte in an undivided electrolytic cell having a cathode and an anode, which comprises:

flowing said manganese chloride electrolyte through said electrolytic cell, said manganese chloride electrolyte being about 0.5M to about 5M $MnCl_2$ at a temperature of about 70 to about 90 degrees Centigrade;

passing electrical current through said electrolytic cell to simultaneously deposit said manganese metal at said cathode and said manganese dioxide at said anode; and continuously removing free hydrochloric acid, formed during said deposition, from said manganese chloride electrolyte to a value of less than 0.1M prior to reuse of said manganese chloride electrolyte.

13. The process of claim 12 wherein said manganese chloride electrolyte is contacted with a strong base ion exchange resin to remove said free hydrochloric acid.

14. The process of claim 13 wherein said manganese chloride electrolyte is contacted with said strong base ion exchange resin in a continuous countercurrent ion exchanger wherein said removed hydrochloric acid is concentrated to about 4–5M.

15. The process of claim 12 wherein said manganese chloride electrolyte is contacted with manganese hydroxide to remove said free hydrochloric acid.

16. The process of claim 12 wherein said manganese chloride electrolyte is contacted with manganese carbonate to remove said free hydrochloric acid.

17. A process for economically producing manganese metal and manganese oxide from manganese containing ores having an assay of about ten percent (10%) manganese, which comprises:

pulverizing said ore to about 30–40 mesh;

contacting said pulverized ore with formic acid to form a formic acid-manganese leach solution;

substantially removing interferring ions from said formic acid-manganese leach solution;

converting manganese of said formic acid-manganese leach solution to a manganese chloride electrolyte of about 4–5M $MnCl_2$, with the release of said formic acid for recycle, by contacting said formic acid-manganese leach solution with about 4–5M hydrochloric acid;

flowing said manganese chloride electrolyte through a heat exchanger to establish said manganese chloride electrolyte at a temperature of about 70–90 degrees Centigrade;

flowing said manganese chloride electrolyte through said electrolytic cell, said manganese chloride electrolyte being about 0.5M to about 5M $MnCl_2$ at a temperature of about 70 to about 90 degrees Centigrade;

passing electrical current through said electrolytic cell to deposit said manganese metal at said cathode and said manganese dioxide at said anode; and continuously removing free hydrochloric acid, formed during said deposition, from said manganese chloride electrolyte to a value of less than 0.1M prior to reuse of said manganese chloride electrolyte.

18. The process of claim 17 wherein said manganese chloride electrolyte is contacted with a strong base ion exchange resin to remove said free hydrochloric acid.

19. The process of claim 17 wherein said manganese chloride electrolyte is contacted with said strong base ion exchange resin in a continuous countercurrent ion exchanger wherein said removed hydrochloric acid is concentrated to about 4–5M.

20. A process for the simultaneous deposition of manganese metal and manganese dioxide from a manganese chloride electrolyte in an undivided electrolytic cell having a cathode and an anode, which comprises:

continuously flowing said manganese chloride electrolyte through said electrolytic cell;

passing electrical current through said electrolytic cell to simultaneously deposit said manganese metal at said cathode and said manganese dioxide at said anode; and continuously contacting said manganese chloride electrolyte with a strong base ion exchange resin to maintain said manganese chloride electrolyte at less than 0.1M free hydrochloric acid.

21. A process for the simultaneous deposition of manganese metal and manganese dioxide from a manganese chloride electrolyte in an undivided electrolytic cell having a cathode and an anode, which comprises:

continuously flowing said manganese chloride electrolyte through said electrolytic cell;

passing electrical current through said electrolytic cell to simultaneously deposit said manganese metal at said cathode and said manganese dioxide at said anode; and continuously contacting said manganese chloride electrolyte with a manganese compound selected from manganese hydroxide and manganese carbonate to maintain said manganese chloride electrolyte at less than 0.1M free hydrochloric acid.

* * * * *